US006850721B2

(12) United States Patent
Repole

(10) Patent No.: US 6,850,721 B2
(45) Date of Patent: Feb. 1, 2005

(54) USER-REPLACEABLE FUSER CARTRIDGE FOR ELECTROPHOTOGRAPHIC PRINTING SYSTEMS

(75) Inventor: Kenzo Repole, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/893,419

(22) Filed: Jul. 15, 2004

(65) Prior Publication Data

US 2004/0247339 A1 Dec. 9, 2004

Related U.S. Application Data

(62) Division of application No. 10/194,590, filed on Jul. 11, 2002, now Pat. No. 6,785,493.

(51) Int. Cl.[7] ..... G03G 15/20
(52) U.S. Cl. ..... 399/122; 399/328
(58) Field of Search ..... 399/107, 110, 399/113, 122, 320, 328, 330; 219/216

(56) References Cited

U.S. PATENT DOCUMENTS

| | | | | | |
|---|---|---|---|---|---|
| 4,384,781 | A | * | 5/1983 | Takada | 399/122 |
| 4,782,359 | A | * | 11/1988 | Tomoe | 399/122 |
| 5,045,887 | A | * | 9/1991 | Nakamura | 399/122 |
| 5,049,945 | A | * | 9/1991 | Fukano et al. | 399/122 |
| 5,191,380 | A | | 3/1993 | Hoover | |
| 5,200,785 | A | | 4/1993 | Hoover et al. | |
| 5,201,852 | A | | 4/1993 | Ogoshi | |
| 5,239,349 | A | | 8/1993 | Hoover | |
| 5,291,256 | A | * | 3/1994 | Kitajima et al. | 399/122 |
| 5,729,798 | A | | 3/1998 | Yasui | |
| 5,842,085 | A | | 11/1998 | Mitsuya | |
| 5,845,176 | A | | 12/1998 | Yoshida | |
| 6,285,846 | B1 | * | 9/2001 | Suzuki et al. | 399/122 |
| 6,490,425 | B2 | | 12/2002 | Konday | |

FOREIGN PATENT DOCUMENTS

| | | |
|---|---|---|
| JP | 407140820 | 6/1995 |
| JP | 2000298383 | 10/2000 |

* cited by examiner

*Primary Examiner*—Sandra L. Brase

(57) ABSTRACT

A user-replaceable fuser cartridge (32) for an electrophotographic printing system. The fuser cartridge (32) includes a first mechanism (40) for partially encasing a fuser (34). When installed, the first mechanism (40) moves in a predetermined direction relative to the fuser (34) but is substantially fixed relative to the surrounding electrophotographic printing system (10). A second mechanism (42) facilitates gripping the first mechanism (40). When the fuser cartridge (32) is removed from the electrophotographic system (10) via the second mechanism (42), a third mechanism (38) selectively encases a portion of the fuser (34) not encased by the first mechanism (40). In a more specific embodiment, the first mechanism (40) includes a shield (40), and the predetermined direction is perpendicular to a longitudinal axis of the fuser (34). The shield (40) is partially curved and concentric with the fuser (34). The second mechanism (42) includes a handle (42) that is mounted on the first mechanism (40). A fuser cartridge receptacle (56) is built into the electrophotographic printing system (10) and has an open end designed to accommodate lateral insertion of the fuser (34). The third mechanism (38) includes a fuser cartridge door (38) that opens and closes upon insertion and removal of the fuser cartridge (32) and accompanying fuser (34) into and out of the fuser cartridge receptacle (56), respectively, thereby exposing the fuser (34) or completely encasing the fuser (34), respectively.

9 Claims, 3 Drawing Sheets

USER-REPLACEABLE FUSER CARTRIDGE FOR ELECTROPHOTOGRAPHIC PRINTING SYSTEMS

CROSS-REFERENCE TO RELATED APPLICATION

This is a Divisional Application of U.S. patent application Ser. No. 10/194,590 filed Jul. 11, 2002 now U.S. Pat. No. 6,785,493 by K. Repole and entitled USER-REPLACEABLE FUSER CARTRIDGE FOR ELECTROPHOTOGRAPHIC PRINTING SYSTEMS.

BACKGROUND OF THE INVENTION

1. Field of Invention

This invention relates to electrophotographic printing systems. Specifically, the present invention relates to systems and methods for facilitating fuser replacement in electrophotographic printing systems.

2. Description of the Related Art

Laser printers and copiers are employed in various demanding applications including mass publishing, copying, and home and office printing applications. Such applications often require cost-effective and reliable printers that require minimal maintenance and have user-serviceable and replaceable components.

A conventional electrophotographic printing system often includes a toner cartridge in communication with a developer and an Electrophotographic (EP) drum or transfer belt. A printing application employs a printer driver to send control signals specifying the output to be printed to a printer controller running on the printer. The printer controller selectively aims a laser at the drum via one more controlled mirrors to produce an electrostatic charge pattern on the drum corresponding to the desired printer output. A developer charges the toner in preparation for transfer to the drum. The developer then exposes the drum to the charged, powdery toner, which sticks to the charged areas of the drum. A transfer assembly, which may include a transfer drum or belt and transfer roller, transfers the toner to the output media as a fuser assembly heats and melts the toner. The fuser assembly often includes a fuser roller (fuser) and an adjacent pressure roller. The pressure roller presses the paper against the hot fuser, which is heated by a fuser lamp to fuse the toner to the paper as the paper passes between the fuser roller and pressure roller. A pressure roller actuator may actuate the pressure roller, which then actuates the fuser roller. The printer controller controls the movement of the pressure roller.

The fuser has a surface film that often breaks down and develops toner rings at the edges of the paper path. Toner rings cause print output defects, such as vertical smears on the output media, and may necessitate replacement of the fuser assembly. A paper jam in the fuser assembly may also require removing the fuser. Paper jams are particularly problematic in applications using various plastic-based papers, such as transparencies, which can melt and stick to the fuser.

Unfortunately, replacing and/or servicing the fuser in a conventional laser printer or copier is often time-consuming and expensive. In many conventional electrophotographic printing systems, the fuser is positioned deep within the printer to accommodate printer design and space constraints. Removing the fuser may require removal of other printer parts, various screws, printer housings, panels, and so on. Furthermore, the fuser is often extremely hot, and may burn an unsuspecting user attempting to replace the fuser. Fuser replacement or repair often requires an outside specialist with detailed knowledge of the printer model. In addition, the fuser is often built into an expensive fuser assembly that must be replaced along with the fuser. Consequently, repairing or replacing a faulty fuser is often prohibitively expensive and may cost more than the printer itself.

To overcome various hazards and expenses associated with replacing fusers in electrophotographic printing systems, various user-replaceable fuser assemblies were developed. Unfortunately, these assemblies often require replacement of the entire fuser assembly with the fuser. The fuser assembly may include a pressure roller, a fuser wicking mechanism, a toner heat lamp, and so on, which are often less susceptible to wear than the fuser itself. Furthermore, in conventional printers employing user-replaceable fuser assemblies, the position of the fuser relative to other printer components may necessitate endwise insertion (where the insertion direction is parallel to the longitudinal axis of the fuser) of the cartridge. Endwise insertion places undesirable design constraints on mechanisms for actuating the cartridge door. Consequently, these printers typically require complicated and expensive cartridge door assemblies to facilitate opening the cartridge door when the user inserts the fuser cartridge and closing the door when the user removes the fuser cartridge. An exemplary user-replaceable fuser assembly is disclosed in U.S. Pat. No. 5,200,785, entitled IMAGE-FORMING APPARATUS FUSER AND CUSTOMER REPLACEABLE FUSING ROLLER CARTRIDGE THEREFOR by Linn C. Hoover et al. The fuser cartridge of the above-referenced patent is inserted and removed perpendicular to the paper path. Consequently, fuser paper jams are difficult to clear. For example, if print media becomes stuck in the fuser, the stuck print media may tear when the fuser is removed from the printer, leaving torn print media stuck in the printer. Furthermore, the fuser cartridge of the above-referenced patent lacks grips to facilitate single-handed cartridge removal.

Hence, a need exists in the art for a cost-effective and safe system and method for facilitating fuser replacement in electrophotographic printing systems that does not require endwise insertion or simultaneous replacement of the pressure roller and fuser.

SUMMARY OF THE INVENTION

The need in the art is addressed by the user-replaceable fuser cartridge of the present invention. In the illustrative embodiment, the inventive fuser cartridge is adapted for use with an electrophotographic printing system, such as a laser printer. The fuser cartridge includes a first mechanism for partially encasing a fuser. The position of the first mechanism is substantially fixed when installed, yet free to move in a predetermined direction relative to the fuser. A second mechanism facilitates gripping the first mechanism. A third mechanism selectively encases a remaining portion of the fuser not encased by the first mechanism when the fuser cartridge is removed from the electrophotographic system via the second mechanism.

In a more specific embodiment, the first mechanism includes a shield, and the predetermined direction is perpendicular to a longitudinal axis of the fuser. The shield is partially curved and concentric with the fuser. The second mechanism includes a handle mounted on the first mechanism. A fuser cartridge receptacle is built into the electrophotographic printing system and has an open end sufficiently shaped to accommodate lateral insertion of the fuser so that insertion and removal of the fuser cartridge occurs parallel to the paper path. The third mechanism includes an automatically actuated fuser cartridge door that opens and closes upon insertion and removal of the fuser cartridge and accompanying fuser into and out of the fuser cartridge receptacle, respectively, to selectively expose the fuser or to completely encase the fuser, respectively.

The novel design according to an embodiment of the present invention is facilitated by the first and third mechanisms, which represent a cost-effective approach to selectively encasing a fuser upon removal and exposing the fuser upon insertion into a fuser cartridge receptacle. The cost-effective approach is facilitated by the overall design of the first and third mechanisms, which enables lateral insertion of the fuser cartridge into the fuser cartridge receptacle. Mounting a handle to the fixed fuser shield facilitates lateral insertion and removal of the fuser cartridge into an electrophotographic printing system by a user. By employing a handle mounted to a fuser shield also facilitates single-handed operation; helps protect the user from hot surfaces; and facilitates general device handling, such as clearing paper jams by enhancing a user's grip on the cartridge.

DESCRIPTION OF A PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
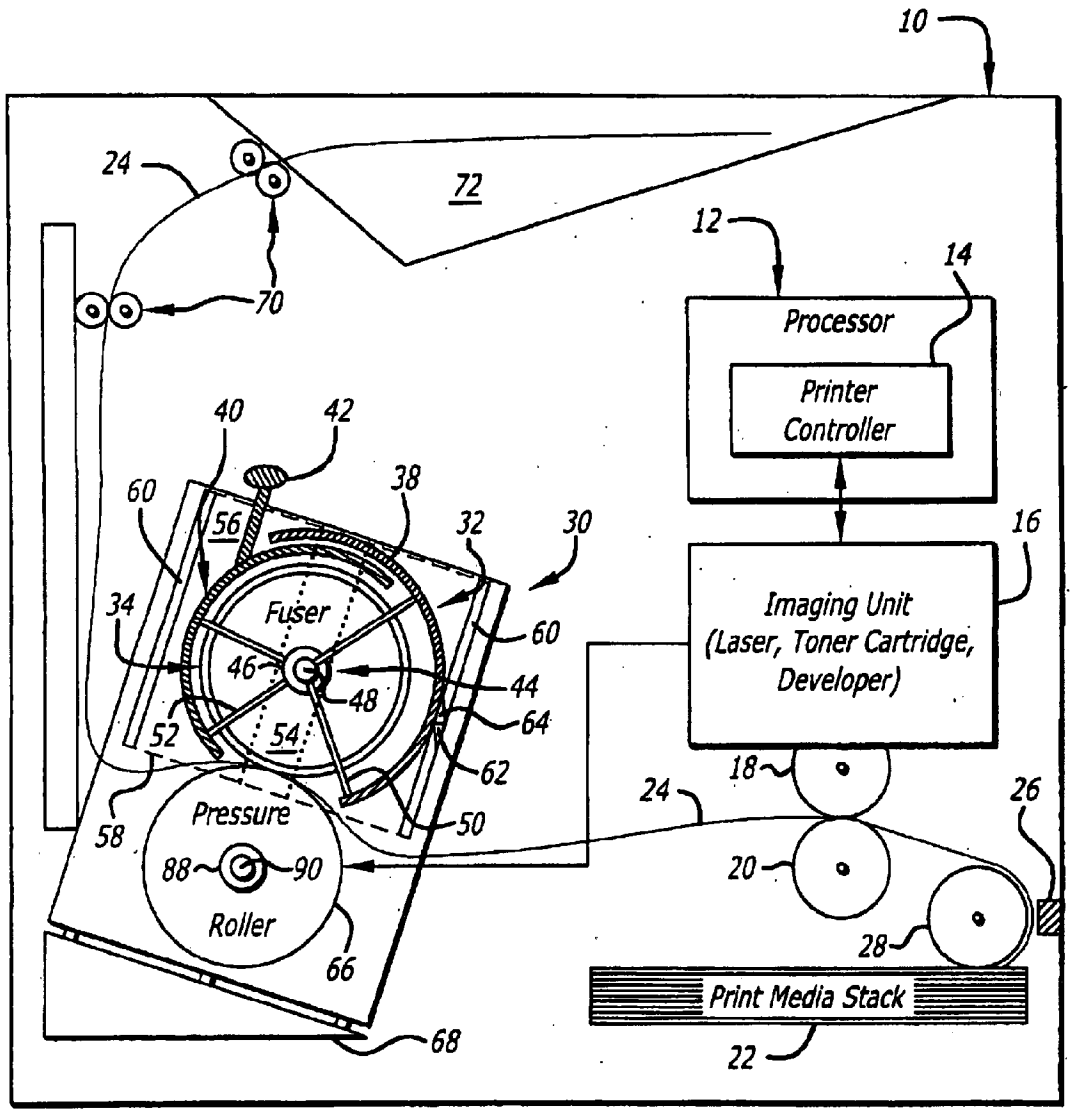
FIG. 1 is a cross-sectional diagram of a laser printer employing a user-replaceable fuser cartridge constructed in accordance with the teachings of the present invention.

FIG. 1 is a cross-sectional diagram of a laser printer 10 employing a user-replaceable fuser cartridge 32 constructed according to the teachings of the present invention. For clarity, various well-known components, such as power supplies, laser-steering mirrors, chargers, various rollers, fuser heat lamps, fuser oil applicators, and so on, have been omitted from FIG. 1. However, those skilled in the art with access to the present teachings will know which components to implement and how to implement them to meet the needs of a given application.

For the purposes of the present discussion, an electrophotographic printing system is any device, such as a laser printer or copier, employing a fuser to facilitate forming an image, including text, on output media, such as paper. A fuser is any device employed to heat toner, ink, or other imaging material to improve adherence of the imaging material to print media. When toner is fused to output media, it is heated to facilitate adherence of the toner to the output media.

The laser printer 10 includes a processor 12 that runs various software modules, including a printer controller 14. In the present specific embodiment, the printer controller 14 communicates with an external software program via a printer driver running on an associated computer (not shown). The printer controller 14 also communicates with a printer imaging unit 16. The imaging unit 16 has an electrophotographic printing sub-system that includes various well known electrophotographic printing components, such as a laser, toner cartridge, developer, and so on, which are sufficient to form an electrostatic toner image on an accompanying transfer drum 18 or belt. The transfer drum 18 is positioned adjacent to and parallel to a developer roller 20. The transfer drum 18 and developer roller 20 roll in opposite directions.

A stack of print media 22 is selectively contacted by a pick mechanism 26 and an adjacent print media pick roller 28. The pick mechanism 16 and roller 28 are responsive to control signals received via the printer controller 14. The control signals selectively cause the pick mechanism 26 and roller 28 to contact the print media stack 22 to facilitate picking the print media 22 and guiding the print media along a media path 24. The construction and operation of applicable prick mechanisms and rollers are known in the art.

The imaging unit 16 provides synchronization input to a fuser assembly 30. The fuser assembly 30 includes a user-replaceable fuser cartridge 32 that contains a fuser roller (fuser) 34 that is selectively surrounded by a rotatably mounted cartridge door 38 and a fixed fuser shield 40. A cartridge handle 42 is rigidly mounted to the fuser shield 40.

The fuser 34 has a concentric mounting support 44 at each end to facilitate mounting of the cartridge door 38 and fuser shield 40. The mounting support 44 does not rotate with the fuser 34, but remains rigid relative to the housing of the fuser assembly 30. The mounting support includes a fixed mounting surface 46 and a spring-loaded mounting surface 48. The fixed mounting surface 46 is fixed relative to the housing of the fuser assembly 30, but may rotate freely relative to the fuser 40. The rotational axis of the fuser 40 is aligned concentric with the mounting surfaces 46 and 48. Hence, the fuser 34 is free to rotate about the mounting surfaces 46 and 48 without exerting any substantial rotational moments about the surfaces 46 and 48. Those skilled in the art may readily implement this functionality via conventional ball bearings or other mechanisms.

The cartridge door 38 is mounted to the spring-loaded mounting surface 48 via cartridge door supports 50. The spring-loaded mounting surface 48 allows the cartridge door to rotate relative the fixed mounting surface 46 and the housing of the fuser assembly 30. The spring-mounting surface 48 is configured to provide resistance opposing clockwise motion of the cartridge door 38. The fuser shield 40 is mounted to the fixed mounting surface 46 via shield supports 52. The mounting surface 46 remains fixed relative to the surrounding fuser assembly 30. Consequently, the orientation of the fuser shield 40 relative to the surrounding fuser assembly 30 remains fixed.

The fuser assembly 30 includes a central cartridge guide 54 formed in sidewalls of a fuser cartridge receptacle 56. The central cartridge guide 54 accommodates the fixed mounting surface 46 and the spring-loaded mounting surface 48. The mounting surface 48 protrudes through side panels 58 (shown dotted) that enclose ends of the fuser cartridge 32, as discussed more fully below.

Receptacle guide slots 60 positioned in the fuser cartridge receptacle 56 are dimensioned to accommodate and guide edges of the side panels 58, and consequently guide the fuser cartridge 32. The receptacle guide slots 60 have one or more stops 62 designed to catch corresponding door catches 64, strategically positioned at the ends of the cartridge door 38, when the fuser cartridge 32 is inserted into the fuser cartridge receptacle 56.

A pressure roller 66 is positioned adjacent to and parallel to the fuser 34. The pressure roller 66 is responsive to synchronizing actuator controls signals received from the imaging unit 16. A pressure roller actuator (not shown) rolls the pressure roller 66 in response to the actuator control signals, which indicate that incoming print media requires fusing. The speed of the pressure roller 66 is adjusted in according to the speeds of the transfer roller 18 and developer roller 20.

When the fuser cartridge 32 is fully inserted in the receptacle 56, the pressure roller 66 contacts the fuser 34 so that actuation of the pressure roller 66 causes corresponding actuation of the fuser 34. Hence, the fuser 40 does not require a separate actuator.

Print media that is picked from the print media stack 22 via the pick roller 28 and the pick mechanism 26 follows the print media path 24. The print media path 24 passes between the transfer drum 18 and the developer roller 20; then between the fuser 34 and the pressure roller 66, which roll in opposite directions; and then between guide rollers 70 before ending in an output bin 72. Various guide rollers, such as guide rollers 70, help maintain the desired media path 24. Additional rollers (not shown), may be positioned in various locations, such as within the fuser assembly 30 to facilitate print media guiding.

In the present specific embodiment, the fuser assembly 30 is mounted on a fuser assembly mount 68, which allows a user to manually longitudinally offset the fuser assembly 30 relative to the paper path 24 to reduce wear on the fuser 34 at the edges of the paper path 24.

In operation, the printer controller 14 receives input from a printing application (not shown), such as a printer driver running on a computer (not shown) that is connected to the printer 10. The input includes encoded information specifying an image to be printed by the printer 10. The printer controller 14 converts the input into control signals, which are passed to the imaging unit 16. The imaging unit 16 selectively aims a laser to create an electrostatic charge pattern on the transfer drum 18 in accordance with the control signals and representative of the image to be printed. A developer charges toner in preparation for application to the surface of the drum 18. The charged toner sticks to the charged areas of the drum 18. The drum 18 and developer roller 20 transfer the toner from the drum 18 on to the print media 22, forming the desired image on the print media 22. The toner applied to the print media 22 via the imaging unit 16, drum 18, and developer roller 20, is heated and fused onto the paper via the fuser 34 of the fuser assembly 30. The fuser 34 is heated, such as via a heat lamp (not shown), and rolled over the print media in response to synchronization signals received from the imaging unit 16. After passing through the fuser assembly 30, the print media 22 passes along the paper path 24, through the guide rollers 70, and into the output bin 72.

Those skilled in the art will appreciate that the laser within the imaging unit 16 may be aimed at an intermediate photo-conductive drum or belt (not shown), rather than directly on the transfer drum 18, to create an electrostatic charge pattern on the photo-conductive drum. Toner in the imaging unit 16 is then applied to the photo-conductive drum, which sticks to the surface of the photo-conductive drum before being transferred to the transfer drum 18 via methods known in the art.

The print media stack 22 is typically a stack of constant-sized print media, such as 8.5" by 11" paper. Protective films on the fuser rollers 34 and 30 breakdown, wear, and accumulate excess toner at positions along the roller surfaces corresponding to the edges of the paper path 24. The resulting defects create blemishes or output defects, such as vertical lines or smears, on the print media Breakdown of the fuser 34, paper jams in the fuser assembly 30, and so on, may necessitate replacing the fuser 34. Removal of the fuser 34, for replacement, refurbishing, removing paper jams, and so on, is facilitated by the user-replaceable fuser cartridge 32, which is laterally inserted into the fuser cartridge receptacle 56, as discussed more fully below.

A user may single-handedly insert the fuser cartridge 32 into the fuser cartridge receptacle 56 by gripping the handle 42 and pushing the cartridge 32 into the receptacle 56. Before the cartridge 32 is inserted or after it is removed, the fuser door 38 is closed so that the bottom ends of fuser door 38 and the fuser shield 40 overlap and so that the top ends of the fuser door 38 and the fuser shield 40 overlap. Consequently, the fuser 34 is completely concealed by the shield 40, door 38, and side panels 58. This protects the user from a potentially hot fuser and protects the delicate fuser film from dirt or other damage.

As the fuser cartridge 32 is inserted into the receptacle 56, the mounting surface 48, which slightly protrudes from the side panels 58, rides in the central cartridge guide 54, while the edges of the side panels 58 ride in the receptacle guide channels 60. An additional latch (not shown) may secure the mounting surface 48 in the central cartridge guide 54 upon full insertion of the cartridge 32 into the receptacle 56. The latch may be overcome with a predetermined pulling force applied to the handle 42. Alternatively, or in addition to the latch, an additional door, such as a printer door, may secure the fuser cartridge 32 in the receptacle 56, preventing the fuser cartridge 32 from moving within said cartridge assembly 30. Such mechanisms for securing a cartridge, such as a toner cartridge, are known in the art.

As the fuser cartridge 32 is inserted into the receptacle 56 of the fuser assembly 30, door catches 64 grip the corresponding stops 62, which are strategically placed in the guide channels 60 of the receptacle 56. The door catches 64 and stops 62 are positioned so that when the fuser cartridge 32 is fully inserted into the receptacle 56, the fuser door 38 is fully open. The door 38 is held open against a spring force applied via the spring-loaded mounting surface 48, which acts like a spring-loaded hinge. When the door 38 is open, sufficient space exists between the bottom ends of the fuser shield 40 and door 38 to allow unobstructed contact between the fuser 40 and the pressure roller 66. The exact space required between bottom ends of the fuser shield 40 and door 38 when the door is open is application-specific and may be readily determined by one skilled in the art to meet the needs of a given application.

To remove the fuser cartridge 32 from the receptacle 56, a user opens any requisite printer doors and may then single-handedly grip and pull on the handle 42. Conventional fusers often require two hands to remove. As the cartridge 32 is pulled out, the mounting surfaces 46 and 48 ride in the central guide 54, while the side panels 58 and the door catches 64 ride in the guide channels 60. As the cartridge 32 slides out of the receptacle 56, the spring-loaded surface 48 causes the cartridge door 38 to close, sealing the fuser 34, thereby protecting the user and the fuser 34.

The fuser shield 40 and the fuser door 38 are constructed from heat resistant materials. Additional heat reflectors or resistive layers may be placed on the inside surfaces of the shield 40 and door 38 without departing from the scope of the present invention.

Those skilled in the art will appreciate that the spring-loaded movable cartridge door 38 may have a smaller radius than the fuser shield 40 (rather than a larger radius as shown in FIG. 1) so that the cartridge door 38 runs under the fuser shield 40 when opened. Furthermore, the spring-loaded door 38 may be designed to pivot about a hinge (not shown) that is strategically mounted to the fuser shield 40 and is mounted parallel to the longitudinal axis of the fuser 34. In this implementation, the ends of the fuser shield 40 are securely glued or molded to the fuser side panels 58. In this alternative implementation, the fuser shield 40 and fuser cartridge door 38 are secured to the side panels 58 via the fuser shield rather than via the fixed mounting surface 46. The swing door may require additional space in the receptacle 56 to accommodate the outward swinging of the door when opening. In addition, the handle 42 may be mounted to the fuser door 38 instead of to the fuser shield 40 without departing from the scope of the present invention.

Alternatively, the upper portion of the inside surface of the fuser door 38 and the upper portion of outside surface of the fuser shield 40 may include special channels (not shown) that allow the fuser door 38 to slide along the outside surface of the fuser shield 40. The channels may secure the fuser door 38 relative to the fuser shield 40 to prevent relative longitudinal motion while allowing relative sliding motion perpendicular to the radius of the fuser 34 and confined in a plane parallel to the end panels 58. These special channels may also be spring loaded so that the spring force causes the door 38 to close upon pulling the cartridge 32 from the receptacle 56.

Those skilled in the art will appreciate that while the cylindrical mounting surfaces 46 and 48 have circular cross-sections, other surfaces with different cross-sections, such as hexagonal or octagonal may be employed for the purposes of the present invention without departing from the scope thereof. The mounting surfaces 46 and 48 may act as electrical contacts for any internal sensors and to apply power to a heating or fusing element (not shown) inside the fuser assembly 30.

Figure 2:
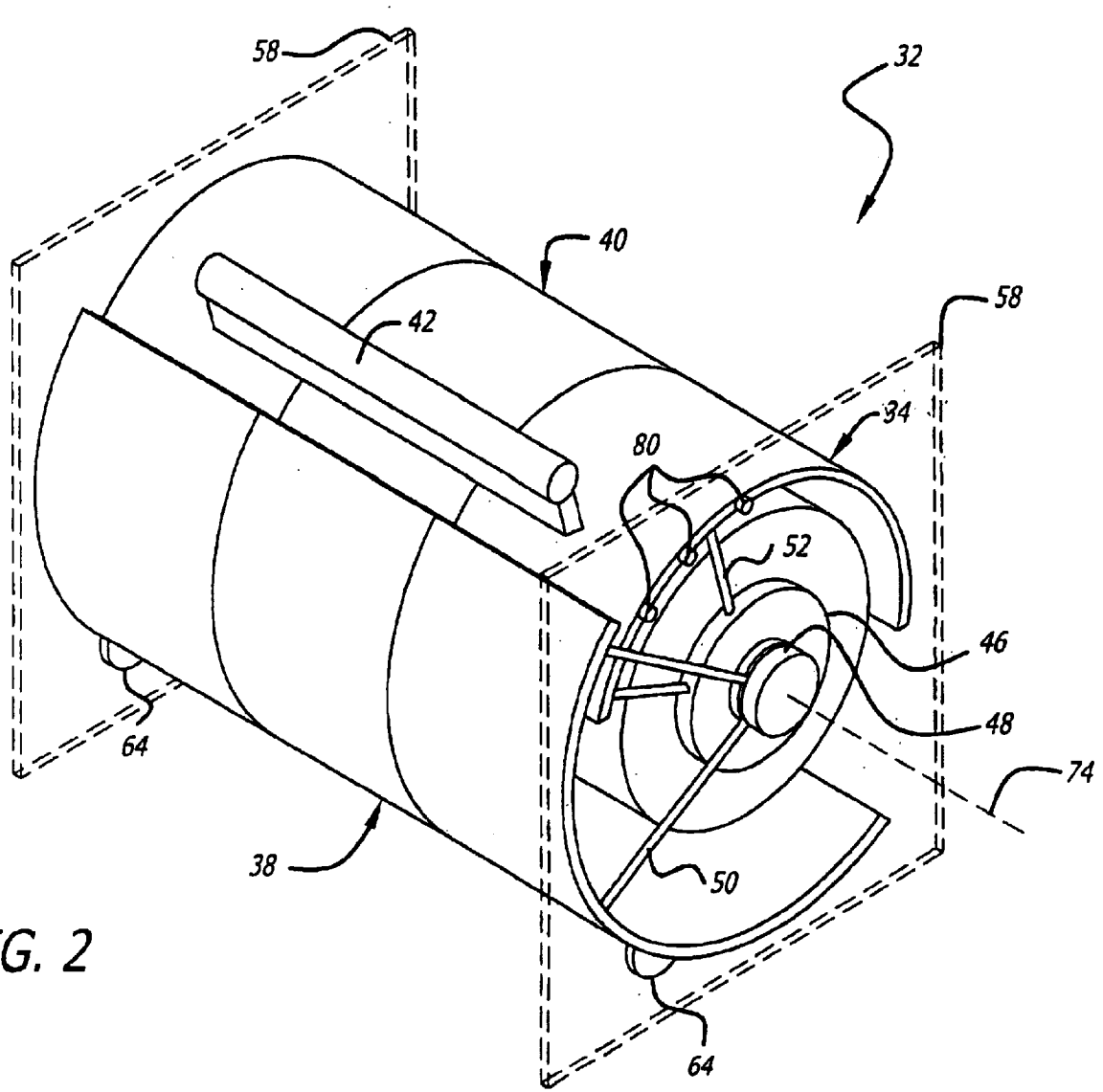
FIG. 2 is a more detailed perspective view of the user-replaceable fuser cartridge of FIG. 1.

FIG. 2 is a more detailed perspective view of the user-replaceable fuser cartridge 32 of FIG. 1. In the present embodiment, the cartridge side panels 58 (shown dotted) are rigidly attached to the fixed fuser shield 40 via connector rods 80 that are perpendicular to the cross-sectional edges of the fuser shield 40. The spring-loaded surface 48 protrudes from the side panels 58 to accommodate central guide tracks 54 of the fuser cartridge receptacle 56 of FIG. 1. The door catches 64 on the fuser door 38 are positioned near the side edges of the fuser door 38 adjacent to the side panels 58 of the fuser cartridge 32.

The fuser cartridge 32 is laterally inserted into the fuser cartridge receptacle 56 of FIG. 1 such that the direction of insertion is approximately perpendicular to a longitudinal axis 74 of the fuser 40. Consequently, the fuser cartridge 32 is adapted for lateral insertion such that the fuser cartridge 32 is inserted and removed in a direction parallel to the paper path 24, which facilitates clearing paper jams, virtually eliminating print media remaining in the printer 10 after removal of the cartridge 32 due to a fuser paper jam. In systems employing endwise insertion, the insertion direction is parallel to the longitudinal axis of the fuser, and perpendicular to the paper path. Consequently, in systems employing endwise insertion, removal of the fuser due to a paper jam may cause tearing of the paper so that a portion of the paper remains stuck within the printer.

Those skilled in the art will appreciate that the supports 50 and 52 may be replaced with single solid support wedges without departing from the scope of the present invention. Furthermore, the mounting surfaces 46 and 48 may be omitted and replaced by a different mechanism (not shown) for securing and supporting the cartridge door 38 and fuser shield 40. Furthermore, the connector rods 80 may be omitted, while the fuser shield instead relies on the shield supports 52 for support. In this embodiment, the side panels are mounted rigidly to a portion of the spring-loaded mounting surface 48 that does not rotate and that is slightly beyond the edges of the cartridge door 38 and fuser shield 40. Consequently, the side panels will remain fixed relative to the fuser shield 40 and the fixed mounting surface 46.

Figure 3:
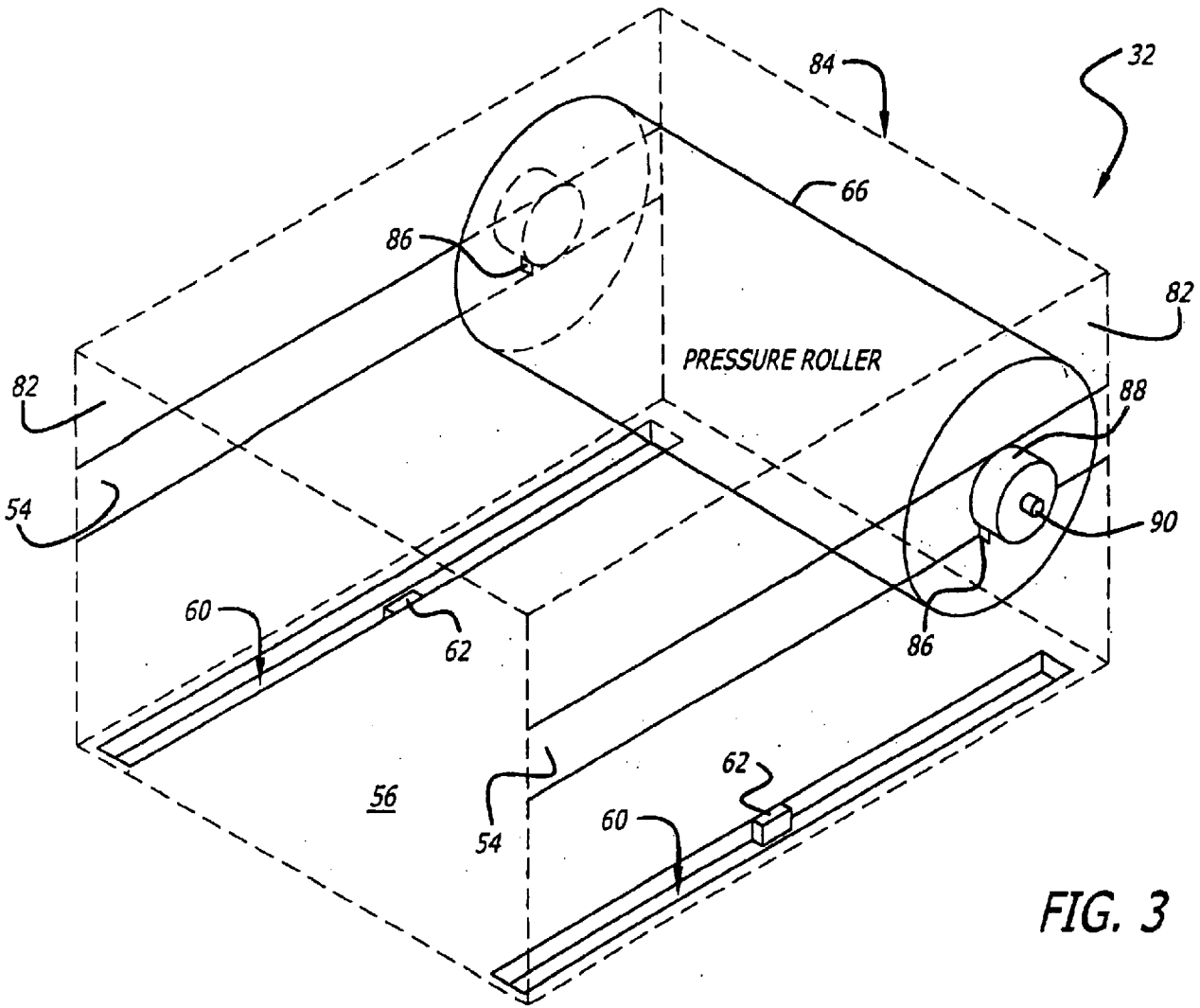
FIG. 3 is a more detailed perspective view showing the fuser cartridge receptacle that is built into the fuser assembly of the laser printer of FIG. 1.

FIG. 3 is a more detailed perspective view showing the fuser cartridge receptacle 56 that is built into the fuser assembly 30 of the laser printer 10 of FIG. 1. The guide channels 60 of the receptacle 56 are positioned on opposite sides of the receptacle 56, near and parallel to sidewalls 82 (shown dotted) of the receptacle 56, which are part of a fuser assembly housing 84 (shown dotted).

With reference to FIGS. 2 and 3, the strategically placed stops 62 are positioned on the inside walls of the guide channels 60 at positions sufficient to stop the door catches 64 of FIG. 2 as the fuser cartridge 32 is inserted into the receptacle 56, thereby opening the cartridge door 38. The central cartridge guides 54 are positioned in the sidewalls 82 to facilitate guiding the fuser cartridge 32 into the receptacle 56 via the portion of the spring-loaded support surface 48 protruding from the cartridge side panels 58 of FIG. 2.

The pressure roller 66 is locked in place in the fuser assembly 30 via locks 86 mounted on a pressure roller axle 88 that rotates relative to the surface of the pressure roller 66. An inner roller axle 90 is rigid relative to the surface of the pressure roller 66 and is linked to an actuator (not shown) via a drive train or other mechanism (not shown). Those skilled in the art may easily order or design and construct sufficient mechanisms, such as actuators and drive trains, for implementing a particular embodiment of the present invention.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications and embodiments within the scope of the present invention.

What is claimed is:

1. A user-replaceable fuser cartridge for an electrophotographic system comprising:

first means for partially encasing a fuser, said first means including a shield;

second means for mounting said shield in an at least partially concentric orientation with respect to said fuser; and third means for gripping said shield, said third means including a handle.

2. The invention of claim 1 wherein said handle has an elongate section connected to said shield at a first end thereof and having a knob at a second end thereof.

3. The invention of claim 1 further including a door mounted in an at least partially concentric orientation with respect to said fuser.

4. A user-replaceable fuser cartridge for an electrophotographic system comprising:

a fuser;

a shield mounted in an at least partially concentric orientation with respect to said fuser; and a handle attached to said shield.

5. The invention of claim 4 wherein said handle has an elongate section connected to said shield at a first end thereof and a knob at a second end thereof.

6. The invention of claim 4 further including a door mounted in an at least partially concentric orientation with respect to said fuser.

7. The invention of claim 6 wherein said door is mounted to pivot at least partially around said fuser.

8. A user-replaceable fuser cartridge for an electrophotographic system comprising:

a fuser;

a shield mounted in an at least partially concentric orientation with respect to said fuser;

a handle attached to said shield, said handle having an elongate section connected to said shield at a first end thereof and a knob at a second end thereof; and a door pivotally mounted in an at least partially concentric orientation with respect to said fuser.

9. A method for allowing user replacement of a fuser cartridge in an electrophotographic system including the steps of:

partially encasing a fuser with a shield;

mounting said shield in an at least partially concentric orientation with respect to said fuser; and attaching a handle to the shield that is suitable for a user to grip when replacing the fuser cartridge.

* * * * *